US011571018B2

(12) United States Patent
Zhou et al.

(10) Patent No.: US 11,571,018 B2
(45) Date of Patent: Feb. 7, 2023

(54) AEROSOL GENERATING ARTICLE HAVING A LOW TEMPERATURE BURNING HEAT SOURCE

(71) Applicant: CHINA TOBACCO ANHUI INDUSTRIAL CO., LTD., Hefei (CN)

(72) Inventors: Shun Zhou, Hefei (CN); Xiaofeng Wang, Hefei (CN); Chenghu Wang, Hefei (CN); Jin Zhang, Hefei (CN); Qing He, Hefei (CN); Xiaoyu Zhang, Hefei (CN); Yaping Zhang, Hefei (CN)

(73) Assignee: CHINA TOBACCO ANHUI INDUSTRIAL CO., LTD., Hefei (CN)

( * ) Notice: Subject to any disclaimer, the term of this patent is extended or adjusted under 35 U.S.C. 154(b) by 398 days.

(21) Appl. No.: 16/907,109

(22) Filed: Jun. 19, 2020

(65) Prior Publication Data

US 2020/0315255 A1 Oct. 8, 2020

Related U.S. Application Data

(63) Continuation of application No. PCT/CN2018/088799, filed on May 29, 2018.

(30) Foreign Application Priority Data

Dec. 22, 2017 (CN) ..... 201711405832.1

(51) Int. Cl.
*A24D 1/22* (2020.01)
*A24F 42/60* (2020.01)
(Continued)

(52) U.S. Cl.
CPC ..... *A24D 1/22* (2020.01); *A24F 42/10* (2020.01); *A24F 42/60* (2020.01); *A24F 42/80* (2020.01)

(58) Field of Classification Search
CPC ..... A24D 1/22; A24F 42/60; A24F 42/80
See application file for complete search history.

(56) References Cited

U.S. PATENT DOCUMENTS 1,989,069 A * 1/1935 Warnke ..... A24F 1/08 131/225
2015/0272210 A1* 10/2015 Liu ..... A24F 13/12 131/257

FOREIGN PATENT DOCUMENTS

CN 101098635 B 12/2010
CN 102458165 A 5/2012
(Continued)

OTHER PUBLICATIONS

Machine Translation of CN 105533800 (Year: 2016).*
(Continued)

*Primary Examiner* — Michael H. Wilson
*Assistant Examiner* — Russell E Sparks
(74) *Attorney, Agent, or Firm* — J.C. Patents

(57) ABSTRACT

Disclosure is an aerosol generating article having a low temperature burning heat source, including a low temperature burning smoking set and a matching cigarette, the smoking set includes a heat insulation sleeve, an annular heat conductive barrel, a cover and a heat source cigarette lighter; the barrel is provided in an annular mounting groove at a left section of an inner wall of the sleeve, the cover is provided at a left end of the sleeve, a cavity of the barrel is filled with the heat source in a sealed manner; a plurality of electric heating columns are provided at a right end of the lighter; the cover is provided with a plurality of insertion holes, and after the plurality of electric heating columns are inserted into the plurality of insertion holes, the lighter gets in contact with the barrel to ignite the heat source in the barrel.

10 Claims, 2 Drawing Sheets

(51) Int. Cl.
*A24F 42/80* (2020.01)
*A24F 42/10* (2020.01)

(56) References Cited

FOREIGN PATENT DOCUMENTS

| | | | | | |
|---|---|---|---|---|---|
| CN | 203538389 | U | | 4/2014 | |
| CN | 104366687 | A | | 2/2015 | |
| CN | 104522882 | A | | 4/2015 | |
| CN | 104602554 | A | | 5/2015 | |
| CN | 204649661 | U | | 9/2015 | |
| CN | 105324047 | A | | 2/2016 | |
| CN | 105410992 | A | | 3/2016 | |
| CN | 105533800 | A | * | 5/2016 | ..... A24D 1/00 |
| CN | 105533800 | A | | 5/2016 | |
| CN | 206354456 | U | | 7/2017 | |
| CN | 108041687 | A | | 5/2018 | |
| WO | WO2013131764 | A1 | | 9/2013 | |

OTHER PUBLICATIONS

International Search Report.
Second Office Action of the priority application.
First Office Action of the priority application.

* cited by examiner

AEROSOL GENERATING ARTICLE HAVING A LOW TEMPERATURE BURNING HEAT SOURCE

CROSS-REFERENCE TO RELATED APPLICATIONS

This application is a continuation of International Application No. PCT/CN2018/088799, filed on May 29, 2018, which claims priority to Chinese Patent Application No. 201711405832.1, filed on Dec. 22, 2017. The disclosures of the aforementioned applications are hereby incorporated by reference in their entireties.

TECHNICAL FIELD

The present disclosure relates to technical field of tobacco products and, in particular, to an aerosol generating article having a low temperature burning heat source.

BACKGROUND

Many studies have shown that nicotine and most flavor components can be released from tobacco at a relatively low temperature (250-500° C.) and transferred into smoke gas. An excessively high temperature is not only increase types and content of hazardous components of the smoke gas, but also converts the flavor components into harmful substances. Therefore, if cigarettes are reduced in temperature below 500° C., that is, the so-called "heat rather than burn tobacco", the harmful components of the smoke gas can be greatly reduced, while the flavor components are relatively less affected, some flavor components may even increase due to reduced pyrolysis.

Based on this idea, a tobacco product with a new concept of "heat rather than burn tobacco" emerges at the right moment. Tobacco shreds of the tobacco product are primarily heated rather than burn, both harmful chemical components and biological toxicity of the smoke gas are greatly reduced. The technical definition of the above tobacco is "Cigarettes that primarily heat rather than burn tobacco" (Heat rather than burn tobacco for short).

The heat rather than burn tobacco product is usually implemented by physically separating the tobacco from a heat source, thus, one of its cores is heat source design and development. At present, for the heat rather than burn tobacco, according to heating principles, there are different types: electric heating (a representative product includes electronic cigarette IQOS® from Philip Morris International and electronic cigarette GLO® from British American Tobacco), fuel heating (a representative product includes electronic cigarette REVO® from R.J. Reynolds Tobacco Company), and physicochemical reaction heating. The electric heating is currently a mainstream patented technology, with the most extensive research and the largest number of patents, however, the technology has deficiencies including complicated electric heating structure, high costs, and necessity in battery replacement. With respect to the physicochemical reaction heating, there is also a problem that it is difficult to control reaction temperature, so the technology implementation is difficult. While the fuel heating technology has simple structure, low costs, and relatively low technical difficulty. Therefore, the fuel heating technology is becoming a good supplement to the electric heating technology, and has gradually received attention. The fuel heating technology mainly utilizes burning of gaseous, liquid, and solid fuel to heat a tobacco core material, where the fuel is mostly in a solid form, mainly a carbonaceous heat source, patents of which accounts for 66.7% of the total patents of low temperature fuel-heating tobacco products. Although the carbonaceous heat source materials have advantages including good safety and stability, fast speed and high efficiency, and low price etc., the following problems still exist: difficulty in ignition, excessively high burning temperature, excessively high CO release, ease of shrinking and falling off, and ease of tobacco shred ignition. Although some problems can be solved by adjusting formula compositions, physical structures and processing technologies, new problems would be brought in, for example, in the patent No. CN101098635B, a micro-nano material is added to reduce CO release, but it results in a problem of trust in safety of the low temperature cigarette; in the patent No. CN102458165A, through provision of multiple longitudinal channels, the surface area of the carbonaceous heat source material is increased, and burning sufficiency and ignitability are increased, however, difficulties and challenges are incorporated for processing; in the patent No. CN102458165A, an insulation material such as a glass fiber is used to wrap the carbonaceous heat source, avoiding the problem of ease of falling off, but the glass fiber will inevitably fall off and is attached to the filter during packaging and transportation, so that a smoker may inhale the glass fiber into the body, this is harmful to health. In addition, although the carbonaceous heat source is not in direct contact with the tobacco, a high temperature (greater than 800° C.) air flow generated by burning of the carbonaceous heat source exists the possibility of igniting tobacco shreds, and once the tobacco shreds combust, a lot of harmful components will be released. Moreover, the heat source and the tobacco of the carbon heat rather than burn cigarette (a typical example, electronic cigarette REVO®) are still in the same cigarette, with deficiencies of complex preparation process and huge investment. In the patent No. CN105533800A, an energetic material for cigarettes and a low temperature heated cigarette are reported, where the heat source has a burning temperature of 400-800° C., which has been greatly reduced compared to the carbonaceous heat source, however, there is still a risk of igniting tobacco shreds; the low temperature heated cigarette designed according to the heat source still follows a structural design similar to that of the carbon heat rather than burn cigarette, and also has a defect of complex preparation process. Therefore, it is necessary to find a new type of heat source material to replace the carbonaceous heat source material, so as to fundamentally solve the problems of excessively high CO production and ignition difficulty. It is desirable that this new heat source material can be combusted at a low temperature of 300-400° C. to fully avoid the problem of tobacco shred being ignited.

SUMMARY

The present disclosure aims to overcome the defects in the prior art, and provides an aerosol generating article having a low temperature burning heat source.

The present disclosure is implemented through technical solutions as follows:

an aerosol generating article having a low temperature burning heat source, including a low temperature burning smoking set and a matching cigarette, where the low temperature burning smoking set includes a heat insulation sleeve, an annular heat conductive barrel, a cover and a heat source cigarette lighter; a left section of an inner wall of the heat insulation sleeve is provided with an annular mounting groove, the annular heat conductive barrel is provided in the annular mounting groove, an outer wall of the annular heat conductive barrel fits with an inner wall of the annular mounting groove, an inner wall of the annular heat conductive barrel is aligned with a right section of the inner wall of the heat insulation sleeve; the cover is provided at a left end of the heat insulation sleeve, the annular heat conductive barrel has a hollow structure with a cavity inside, the cavity of the annular heat conductive barrel is filled with a low temperature burning heat source in a sealed manner; a plurality of electric heating columns are provided at a right end of the heat source cigarette lighter, the cover is provided with a plurality of insertion holes matching the plurality of electric heating columns of the heat source cigarette lighter, and after the plurality of electric heating columns are inserted into the plurality of insertion holes on the cover, the heat source cigarette lighter gets in contact with the annular heat conductive barrel to ignite the low temperature burning heat source in the annular heat conductive barrel;

the matching cigarette consists of a smoke releasing section, a temperature lowering section and a solid filter section connected in sequence from left to right, and the matching cigarette is wrapped with a layer of antiflaming cigarette paper, the matching cigarette is inserted into the heat insulation sleeve from a right end of the low temperature burning smoking set, and a length of the smoke releasing section of the matching cigarette in the axial direction is greater than a length of the annular heat conductive barrel in the axial direction;

the low temperature burning heat source is prepared by mixing the following raw materials in percentage by mass:

60%-80% of oxidant, 10%-15% of carbon powder, 5%-15% of binding agent, and 1%-5% of burning rate modifier.

As a preferred embodiment of the above technical solution, a first magnetic ring is provided at the left end of the heat insulation sleeve, a second magnetic ring is provided at a periphery of the cover, the cover is connected to the heat insulation sleeve through attraction between the first magnetic ring and the second magnetic ring.

As a preferred embodiment of the above technical solution, a central vent hole is provided in a center of the cover.

As a preferred embodiment of the above technical solution, the low temperature burning heat source in the annular heat conductive barrel has a filling volume which accounts for ½-⅔ of a total volume of the cavity.

As a preferred embodiment of the above technical solution, the low temperature burning heat source has a density of 1.8-2.4 g/cm$^2$ and a burning temperature of 300-400° C.

As a preferred embodiment of the above technical solution, the smoke releasing section has a smoke release medium selected from any one of tobacco shreds, tobacco particles and porous tobacco rods.

As a preferred embodiment of the above technical solution, the oxidant consists of a high melting point oxidant and a low melting point oxidant with a mass ratio of 1:9.4 to 1:16.8; the high melting point oxidant has a melting point higher than 550° C.; the low melting point oxidant has a melting point lower than 400° C.

As a preferred embodiment of the above technical solution, the high melting point oxidant is selected from a group consisting of strontium nitrate, barium nitrate, palladium nitrate and calcium nitrate; the low melting point oxidant is selected from a group consisting of potassium nitrate, sodium nitrate, potassium chlorate, copper nitrate, magnesium nitrate, lithium nitrate and calcium chlorate.

As a preferred embodiment of the above technical solution, the binding agent consists of starch and clay with a mass ratio of 1:0.5 to 1:1.5.

As a preferred embodiment of the above technical solution, the burning rate modifier consists of silicon dioxide and ferric oxide with a mass ratio of 1:1 to 1:2.

As a preferred embodiment of the above technical solution, the carbon powder has a particle diameter of ≤60 meshes, fixed carbon content is ≥85%, volatile content is ≤15%, moisture content is ≤5%, ash content is ≤3%.

Compared with the prior art, the present disclosure has the following advantages: according to the aerosol generating article having the low temperature burning heat source provided in the present disclosure, a low temperature burning smoking set and a matching cigarette thereof are two independent components that cooperate with each other, thus separate manufacture of the low temperature burning smoking set and the matching cigarette is achieved, with a simple manufacturing process and low costs. At the same time, the low temperature burning heat source according to the present disclosure can self-maintain stable burning at a temperature of 300-400° C., ignition can be achieved through the heat source cigarette lighter, which is easy to operate and easy to ignite. Since the low temperature burning heat source is sealed in the cavity of the annular heat conductive barrel, no ambient air is required for burning, and burning products are still encapsulated in the annular heat conductive barrel, thus the burning products has a lower CO content, thereby fundamentally avoiding the defects that the carbonaceous heat source has excessively high CO production, and the burning collapses and falls off, meanwhile avoiding potential safety hazards caused by use of the glass fiber.

Reference signs in the accompanying drawings: 1—cover, 11—central vent hole, 12—insertion hole, 13—second magnetic ring, 2—low temperature burning heat source, 3—heat insulation sleeve, 4—annular heat conductive barrel, 41—cavity, 5—heat source cigarette lighter, 51—electric heating column, 6—smoke releasing section, 7—temperature lowering section, 8—solid filter section, 9—antiflaming cigarette paper.

DETAILED DESCRIPTION

Examples of the present disclosure will be described below in detail. The examples are implemented on the premise of the technical solutions of the present disclosure. Detailed implementations and specific operation processes are illustrated, but the protection scope of the present disclosure is not limited to the following examples.

Figure 1:
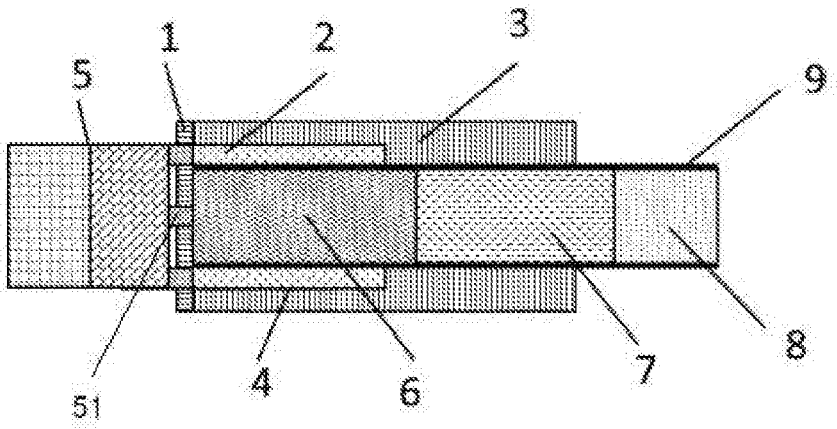
FIG. 1 is an overall schematic structural diagram according to the present disclosure.
Figure 2:
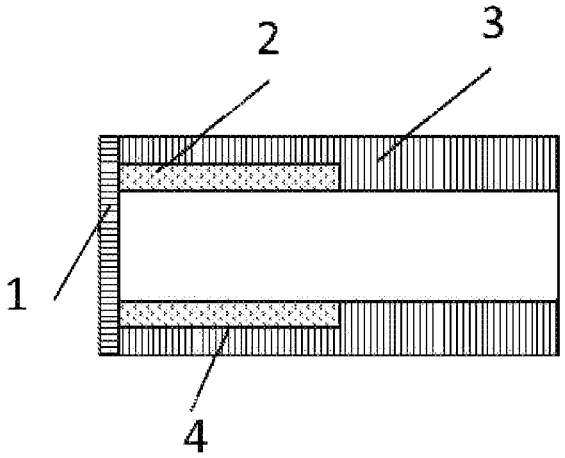
FIG. 2 is a schematic structural diagram of a low temperature burning smoking set according to the present disclosure.
Figure 3:
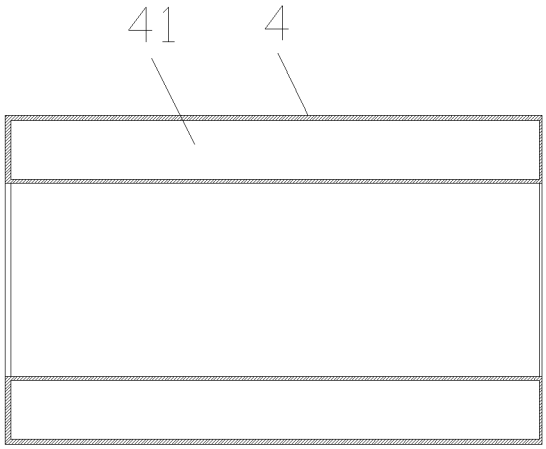
FIG. 3 is a longitudinal section view of an annular heat conductive barrel according to the present disclosure.
Figure 4:
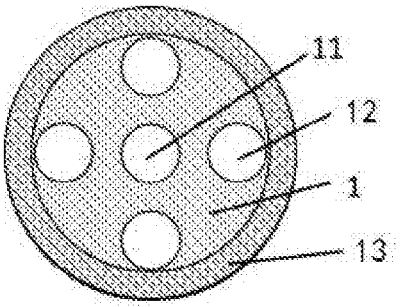
FIG. 4 is a transverse section view of a cover according to the present disclosure.

With Reference to FIG. 1 to FIG. 4, the present disclosure discloses an aerosol generating article having a low temperature burning heat source, including a low temperature burning smoking set and a matching cigarette, where the low temperature burning smoking set includes a heat insulation sleeve 3, an annular heat conductive barrel 4, a cover 1 and a heat source cigarette lighter 5; a left section of an inner wall of the heat insulation sleeve 3 is provided with an annular mounting groove, the annular heat conductive barrel 4 is provided in the annular mounting groove, the annular heat conductive barrel 4 may be an aluminum barrel, an outer wall of the annular heat conductive barrel 4 fits with the inner wall of the annular mounting groove, an inner wall of the annular heat conductive barrel 4 is aligned with the inner wall at a right section of the heat insulation sleeve 3; the cover 1 is provided at a left end of the heat insulation sleeve 3, a first magnetic ring is provided at the left end of the heat insulation sleeve 3, a second magnetic ring 13 is provided at a periphery of the cover 1, the cover 1 is connected to the heat insulation sleeve 3 through attraction between the first magnetic ring and the second magnetic ring 13.

The annular heat conductive barrel 4 has a hollow structure with a cavity 41 inside, the cavity 41 of the annular heat conductive barrel 4 is filled with a low temperature burning heat source 2 in a sealed manner, the low temperature burning heat source 2 in the annular heat conductive barrel 4 has a filling volume which accounts for ½-⅔ of the total volume of the cavity 41; a plurality of electric heating columns 51 are provided at a right end of the heat source cigarette lighter 5, a central vent hole 11 is provided in the center of the cover 1, the cover 1 is provided with a plurality of insertion holes 12 matching the plurality of electric heating columns 51 of the heat source cigarette lighter 5, and after the plurality of electric heating columns 51 are inserted into the plurality of insertion holes 12 on the cover 1, the heat source cigarette lighter 5 gets in contact with the annular heat conductive barrel 4 to ignite the low temperature burning heat source 2 in the annular heat conductive barrel 4;

the matching cigarette consists of a smoke releasing section 6, a temperature lowering section 7 and a solid filter section 8 connected in sequence from left to right, and the matching cigarette is wrapped with a layer of antiflaming cigarette paper 9, the matching cigarette is inserted into the heat insulation sleeve 3 from a right end of the low temperature burning smoking set, and a length of the smoke releasing section 6 of the matching cigarette in the axial direction is greater than a length of the annular heat conductive barrel 4 in the axial direction.

The heat insulation sleeve 3 has a length of 35-50 mm and an outer diameter of 8 mm-12 mm. The heat insulation sleeve 3 has an inner diameter of 5-7.5 mm at its right section, and the annular mounting groove of the heat insulation sleeve 3 has an inner diameter of 7 mm-9 mm. The annular heat conductive barrel 4 has a wall thickness of 50-100 μm. The heat insulation sleeve 3 may be made of porous cordierite. The heat source cigarette lighter 5 has a heating temperature of 750 f 20° C.

When using, the matching cigarette is put into the low temperature burning smoking set, the low temperature burning heat source 2 in the low temperature burning smoking set is subjected to low temperature burning, and releases heat, the heat is transferred to heat the matching cigarette within the low temperature burning smoking set, so as to generate smoke gas; where the low temperature burning heat source 2 prepared in Example 13-Example 15 and Example 17-Example 21 described below may be subjected to low temperature burning and heat release at a temperature of 300-400 degrees. The aerosol generating article possesses advantages of a simple manufacturing process, low costs, no CO release from the heat source, and no falling off of the heat source.

The low temperature burning heat source 2 can be prepared according to any one of the following examples.

Example 1

After 20 g of charcoal powder and 10 g of starch are subjected to drying, grinding and sieving through a screen of 60 meshes (drying condition: 50° C.×2 h; grinding), they are mixed uniformly, then 80 g of potassium nitrate is added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 2

After 20 g of charcoal powder and 10 g of starch are subjected to drying, grinding and sieving through a screen of 60 meshes (drying condition: 50° C.×2 h; grinding), they are mixed uniformly, then 40 g of potassium nitrate is added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm. The burning test result: burning intensely with flames.

Example 3

After 20 g of charcoal powder and 10 g of starch are subjected to drying, grinding and sieving through a screen of 60 meshes (drying condition: 50° C.×2 h; grinding), they are mixed uniformly, then 85 g of strontium nitrate is added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 4

After 20 g of charcoal powder and 10 g of starch are subjected to drying, grinding and sieving through a screen of 60 meshes (drying condition: 50° C.×2 h; grinding), they are mixed uniformly, then 42.5 g of strontium nitrate is added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 5

After 20 g of charcoal powder and 10 g of starch are subjected to drying, grinding and sieving through a screen of 60 meshes (drying condition: 50° C.×2 h; grinding), they are mixed uniformly, then 42.5 g of strontium nitrate and 40 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 6

After 20 g of charcoal powder and 10 g of starch are subjected to drying, grinding and sieving through a screen of 60 meshes (drying condition: 50° C.×2 h; grinding), they are mixed uniformly, then 80.8 g of strontium nitrate and 4.5 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 7

After 20 g of charcoal powder and 10 g of starch are subjected to drying, grinding and sieving through a screen of 60 meshes (drying condition: 50° C.×2 h; grinding), they are mixed uniformly, then 80.6 g of strontium nitrate and 4.8 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 8

After 20 g of charcoal powder and 10 g of starch are subjected to drying, grinding and sieving through a screen of 60 meshes (drying condition: 50° C.×2 h; grinding), they are mixed uniformly, then 77.8 g of strontium nitrate and 7.4 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 9

After 20 g of charcoal powder and 10 g of starch are subjected to drying, grinding and sieving through a screen of 60 meshes (drying condition: 50° C.×2 h; grinding), they are mixed uniformly, then 77 g of strontium nitrate and 8.2 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 10

After 20 g of charcoal powder and 10 g of starch are subjected to drying, grinding and sieving through a screen of 60 meshes (drying condition: 50° C.×2 h; grinding), they are mixed uniformly, then 74.9 g of strontium nitrate and 10.2 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 11

After 20 g of charcoal powder and 10 g of starch are subjected to drying, grinding and sieving through a screen of 60 meshes (drying condition: 50° C.×2 h; grinding), they are mixed uniformly, then 71.3 g of strontium nitrate and 13.6 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 12

After 18 g of charcoal powder, 11 g of starch and 4 g of clay are subjected to drying, grinding and sieving through a screen of 60 meshes (drying condition: 50° C.×2 h; grinding), they are mixed uniformly, then 67.4 g of strontium nitrate and 9.2 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 13

After 18 g of charcoal powder, 10 g of starch and 5 g of clay are subjected to drying, grinding and sieving through a screen of 60 meshes (drying condition: 50° C.×2 h; grinding), they are mixed uniformly, then 67.4 g of strontium nitrate and 9.2 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 14

After 18 g of charcoal powder, 7.5 g of starch and 7.5 g of clay are subjected to drying, grinding and sieving through a screen of 60 meshes (drying condition: 50° C.×2 h; grinding), they are mixed uniformly, then 67.4 g of strontium nitrate and 9.2 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 15

After 18 g of charcoal powder, 5 g of starch and 10 g of clay are subjected to drying, grinding and sieving through a screen of 60 meshes (drying condition: 50° C.×2 h; grinding), they are mixed uniformly, then 67.4 g of strontium nitrate and 9.2 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 16

After 18 g of charcoal powder, 4 g of starch and 11 g of clay are subjected to drying, grinding and sieving through a screen of 60 meshes (drying condition: 50° C.×2 h; grinding), they are mixed uniformly, then 67.4 g of strontium nitrate and 9.2 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 17

After 17.5 g of charcoal powder, 9.7 g of starch, 4.9 g of clay, 1.4 g of silicon dioxide and 1.6 g of ferric oxide are subjected to drying, grinding and sieving through a screen of 60 meshes (drying condition: 50° C.×2 h; grinding), they are mixed uniformly, then 65.3 g of strontium nitrate and 8.9 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 18

After 17.5 g of charcoal powder, 9.7 g of starch, 4.9 g of clay, 1.5 g of silicon dioxide and 1.5 g of ferric oxide are subjected to drying, grinding and sieving through a screen of 60 meshes (drying condition: 50° C.×2 h; grinding), they are mixed uniformly, then 65.3 g of strontium nitrate and 8.9 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 19

After 17.5 g of charcoal powder, 9.7 g of starch, 4.9 g of clay, 1.8 g of silicon dioxide and 1.2 g of ferric oxide are subjected to drying, grinding and sieving through a screen of 60 meshes (drying condition: 50° C.×2 h; grinding), they are mixed uniformly, then 65.3 g of strontium nitrate and 8.9 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 20

After 17.5 g of charcoal powder, 9.7 g of starch, 4.9 g of clay, 2 g of silicon dioxide and 1 g of ferric oxide are subjected to drying, grinding and sieving through a screen of 60 meshes (drying condition: 50° C.×2 h; grinding), they are mixed uniformly, then 65.3 g of strontium nitrate and 8.9 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 21

After 17.5 g of charcoal powder, 9.7 g of starch, 4.9 g of clay, 2.2 g of silicon dioxide and 0.8 g of ferric oxide are subjected to drying, grinding and sieving through a screen of 60 meshes (drying condition: 50° C.×2 h; grinding), they are mixed uniformly, then 65.3 g of strontium nitrate and 8.9 g of potassium nitrate are added, after uniform mixing 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

Example 22

After 91.7 g of charcoal powder, 9.7 g of starch, 4.9 g of clay, 2.2 g of silicon dioxide and 0.8 g of ferric oxide are subjected to drying, grinding and sieving through a screen of 60 meshes (drying condition: 50° C.×2 h; grinding), they are mixed uniformly, then 30 g of water is added, after uniform mixing the resulting mixture is fed into a screw extruder, an extrudate is dried at 60° C. for 4 h, then an annular low temperature combustion heat source 2 with an inner diameter of 6.0 mm, an outer diameter of 7.6 mm and a length of 50 mm.

A thermal infrared imager is utilized to test burning temperature of each heat source, and the instrument emissivity is set to 0.9; a cone calorimeter is utilized to test CO release from burning of each heat source; the burning rate test method for the carbonaceous heat source invented in the patent No. CN204649661U is utilized to measure burning rate of each heat source. The above test results are summarized, as shown in Table 1.

TABLE 1

Burning Characteristic Parameters of Each Heat Source

| Sample Name | Burning Phenomena | Burning rate (mm/min) | Burning Temperature (° C.) | CO Release (mg/g) |
|---|---|---|---|---|
| Example 22 | Cannot burn in the absence of oxygen, can maintain burning in air | 5.2 | 853 | 230 |
| Example 1 | Burning intensely with flames, in the absence of oxygen | 45.3 | 839 | 3.0 |

TABLE 1-continued

| Burning Characteristic Parameters of Each Heat Source | | | | |
|---|---|---|---|---|
| Sample Name | Burning Phenomena | Burning rate (mm/min) | Burning Temperature (° C.) | CO Release (mg/g) |
| Example 2 | Burning fast with flames, in the absence of oxygen | 36.8 | 790 | 5.1 |
| Example 3 | Cannot perform self-sustaining burning in the absence of oxygen | | | |
| Example 4 | Cannot perform self-sustaining burning in the absence of oxygen | | | |
| Example 5 | In the absence of oxygen, burning slows down compared with Example 1 and Example 2, but the burning is still relatively intense | 28.6 | | 4.9 |
| Example 6 | Cannot perform self-sustaining burning in the absence of oxygen | | | |
| Example 7 | Can perform self-sustaining burning in snatches in the absence of oxygen | | | |
| Example 8 | Sustain burning slowly, without flames, in the absence of oxygen | | 433 | |
| Example 9 | Performing self-sustaining burning with basically no flame, in the absence of oxygen | 22.9 | 457 | |
| Example 10 | Performing self-sustaining burning with basically no flame, in the absence of oxygen | 24.0 | 465 | |
| Example 11 | Performing self-sustaining burning with basically no flame, in the absence of oxygen | 25.3 | 505 | |
| Example 12 | Performing self-sustaining burning with basically no flame, in the absence of oxygen | 21.1 | 413 | |
| Example 13 | Performing self-sustaining burning with basically no flame, in the absence of oxygen | 20.2 | 396 | |
| Example 14 | Performing self-sustaining burning with basically no flame, in the absence of oxygen | 19.6 | 351 | |
| Example 15 | Performing self-sustaining burning with basically no flame, in the absence of oxygen | 18.9 | 313 | |
| Example 16 | Cannot sustain burning in the absence of oxygen | | | |
| Example 17 | Performing self-sustaining burning with basically no flame, in the absence of oxygen | 16.8 | 389 | |
| Example 18 | Performing self-sustaining burning with basically no flame, in the absence of oxygen | 14.4 | 380 | 5.0 |
| Example 19 | Performing self-sustaining burning with basically no flame, in the absence of oxygen | 10.7 | 384 | 4.8 |
| Example 20 | Performing self-sustaining burning with basically no flame, in the absence of oxygen | 6.6 | 379 | 4.7 |
| Example 21 | Performing self-sustaining burning with basically no flame, in the absence of oxygen | 4.5 | 383 | |

From comparison among Example 1, Example 2, Example 3 and Example 4, it can be seen that when the oxidant is just potassium nitrate, the burning is intense, with a relatively high temperature; when the oxidant is just strontium nitrate, no matter it is equivalent or excessive, the burning cannot sustain.

From comparison among Example 5, Example 6, Example 7, Example 8, Example 9, Example 10 and Example 11, it can be seen that when potassium nitrate and strontium nitrate are used together as the oxidant, the burning can be self-maintained only in the case that a mass ratio of potassium nitrate to strontium nitrate is between 1:9.4 and 1:16.8, but the burning rate is still relatively fast, and the burning temperature is higher than 400'° C.

From comparison among Example 12, Example 13, Example 14, Example 15 and Example 16, it can be seen that when the binding agent contains clay, the burning temperature is significantly reduced, and as the proportion of the clay increases, the burning temperature drops below 400° C., however, the burning cannot sustain when the content of the clay is excessively high.

From comparison among Example 17, Example 18, Example 19, Example 20 and Example 21, it can be seen that when silicon dioxide and ferric oxide are added, the burning rate of the heat source can be significantly reduced, and when a mass ratio of silicon dioxide to ferric oxide is between 1:1 and 1:2, the burning rate of the heat source can be adjusted to a range of 5-15 mm/min.

From comparison among Example 1, Example 2, Example 5, Example 18, Example 19, Example 20 and Example 22, it can be seen that the CO release of the carbonaceous heat source is much higher than that of the low temperature burning heat source 2 provided in the present disclosure, indicating that the low temperature burning heat source 2 according to the present disclosure has a significant advantage in reducing the CO release.

The above examples are just preferred examples of the present disclosure, but not used to limit the present disclosure. Any modification, equivalent substitution, improvement, etc. made within the spirit and principle of the present disclosure should fall into the protection scope of the present disclosure.

What is claimed is:

1. An aerosol generating article having a low temperature burning heat source, comprising a low temperature burning smoking set and a matching cigarette, the low temperature burning smoking set comprises a heat insulation sleeve, an annular heat conductive barrel, a cover and a heat source cigarette lighter; a left section of an inner wall of the heat insulation sleeve is provided with an annular mounting groove, the annular heat conductive barrel is provided in the annular mounting groove, an outer wall of the annular heat conductive barrel fits with an inner wall of the annular mounting groove, an inner wall of the annular heat conductive barrel is aligned with a right section of the inner wall of the heat insulation sleeve; the cover is provided at a left end of the heat insulation sleeve, the annular heat conductive barrel has a hollow structure with a cavity inside, the cavity of the annular heat conductive barrel is filled with a low temperature burning heat source in a sealed manner; a plurality of electric heating columns are provided at a right end of the heat source cigarette lighter, the cover is provided with a plurality of insertion holes matching the plurality of electric heating columns of the heat source cigarette lighter, and after the plurality of electric heating columns are inserted into the plurality of insertion holes on the cover, the heat source cigarette lighter gets in contact with the annular heat conductive barrel to ignite the low temperature burning heat source in the annular heat conductive barrel;

the matching cigarette consists of a smoke releasing section, a temperature lowering section and a solid filter section connected in sequence from left to right, and the matching cigarette is wrapped with a layer of antiflaming cigarette paper, the matching cigarette is inserted into the heat insulation sleeve from a right end of the low temperature burning smoking set, and a length of the smoke releasing section of the matching cigarette in the axial direction is greater than a length of the annular heat conductive barrel in the axial direction;

the low temperature burning heat source is prepared by mixing the following raw materials in percentage by mass:

60%-80% of oxidant, 10%-15% of carbon powder, 5%-15% of binding agent, and 1%-5% of burning rate modifier.

2. The aerosol generating article having the low temperature burning heat source according to claim 1, wherein a first magnetic ring is provided at the left end of the heat insulation sleeve, a second magnetic ring is provided at a periphery of the cover, the cover is connected to the heat insulation sleeve through attraction between the first magnetic ring and the second magnetic ring.

3. The aerosol generating article having the low temperature burning heat source according to claim 1, wherein a central vent hole is provided in a center of the cover.

4. The aerosol generating article having the low temperature burning heat source according to claim 1, wherein the low temperature burning heat source in the annular heat conductive barrel has a filling volume which accounts for ½-⅔ of a total volume of the cavity.

5. The aerosol generating article having the low temperature burning heat source according to claim 1, wherein the low temperature burning heat source has a density of 1.8-2.4 $g/cm^2$ and a burning temperature of 300-400° C.

6. The aerosol generating article having the low temperature burning heat source according to claim 1, wherein the smoke releasing section has a smoke release medium selected from any one of tobacco shreds, tobacco particles and porous tobacco rods.

7. The aerosol generating article having the low temperature burning heat source according to claim 1, wherein the oxidant consists of a high melting point oxidant and a low melting point oxidant with a mass ratio of 1:9.4 to 1:16.8; the high melting point oxidant has a melting point higher than 550° C.; the low melting point oxidant has a melting point lower than 400° C.

8. The aerosol generating article having the low temperature burning heat source according to claim 7, wherein the high melting point oxidant is selected from a group consisting of strontium nitrate, barium nitrate, palladium nitrate and calcium nitrate; the low melting point oxidant is selected from a group consisting of potassium nitrate, sodium nitrate, potassium chlorate, copper nitrate, magnesium nitrate, lithium nitrate and calcium chlorate.

9. The aerosol generating article having the low temperature burning heat source according to claim 1, wherein the burning rate modifier consists of silicon dioxide and ferric oxide with a mass ratio of 1:1 to 1:2.

10. The aerosol generating article having the low temperature burning heat source according to claim 1, wherein the carbon powder has a particle diameter of ≤60 meshes, fixed carbon content is ≥85%, volatile content is ≤15%, moisture content is ≤5%, ash content ≤3%.

* * * * *